US007954242B1

(12) United States Patent
Brizan

(10) Patent No.: US 7,954,242 B1
(45) Date of Patent: Jun. 7, 2011

(54) ELECTRIC NAIL CLIPPER

(76) Inventor: Hollis Brizan, Brooklyn, NY (US)

( * ) Notice: Subject to any disclaimer, the term of this patent is extended or adjusted under 35 U.S.C. 154(b) by 222 days.

(21) Appl. No.: 12/390,526

(22) Filed: Feb. 23, 2009

(51) Int. Cl.
*A45D 29/02* (2006.01)

(52) U.S. Cl. ..... 30/28; 132/75.5

(58) Field of Classification Search ..... 30/26, 28, 30/180, 253; 132/75.5; D28/60
See application file for complete search history.

(56) References Cited

U.S. PATENT DOCUMENTS 1,685,977 A * 10/1928 Bollerman ..... 30/91.2
5,123,430 A * 6/1992 Davidovitz ..... 132/75.8
5,307,824 A 5/1994 Bannett
5,791,049 A * 8/1998 Dolev ..... 30/28
6,173,497 B1 1/2001 Domenge
6,557,259 B1 5/2003 Nguyen
D497,221 S 10/2004 Yeung
6,865,812 B1 3/2005 Martin, Jr.
2009/0119922 A1 * 5/2009 Doyle et al. ..... 30/28

* cited by examiner

*Primary Examiner* — Hwei-Siu C Payer
(74) *Attorney, Agent, or Firm* — Lawrence J. Gibney, Jr.

(57) ABSTRACT

This invention will assist individuals to either manually or automatically clip a toenail or fingernail. The fingernail or toenail is inserted into the front end of the device and a pair of trimming edges move together to clip the fingernail or toenail safely, easily and conveniently. One of the embodiments contemplates a manual device and the other is an electric device.

3 Claims, 2 Drawing Sheets

ELECTRIC NAIL CLIPPER

BACKGROUND OF THE INVENTION

A. Field of the Invention

This relates to trimming fingernails and toenails. This may be helpful with an individual who has limited strength. One embodiment is manual and the other is electric.

B. Prior Art

There are many other prior art references to nail clippers and electric nail clippers in general. An example is Martin, U.S. Pat. No. 6,865,812. Martin is a nail trimmer for a person to be able to comfortably trim toenails without having to assume an awkward position. This device is not electric; however, it is manual and is designed for people who cannot bend.

Another example that can be found in the art prior is Dunn Jr., U.S. Pat. No. 4,847,994. This is a remotely actuated toenail clipper. Again, it functions like Martin in that it is designed to trim toenails from a remote location and would assist those individuals who have difficulty bending or stooping.

BRIEF SUMMARY OF THE INVENTION

This is a nail clipper that will come in two models. One is a manual model and the other is an electric model. The operation of the nail clipper will basically function the same in both instances, that is, to clip a toenail or fingernail.

In the manual model, there will be a soft pad on the top surface for the comfort of the user. A set of trimming edges will be positioned at the end of a pair of horizontal members. At the opposite end of the horizontal members will be a pivot point that connects the horizontal members. A spring is located somewhere near the trimming edge to ensure that the device remains open during normal operation.

The entire device will be surrounded by a plastic case. In order to make sure that the trimming edges move in a uniform direction, a guide, which will move within a cavity, is provided.

In the electric model, instead of the individual pressing down on the soft pad, a push switch is placed on the front of the device. The device will probably be operated by standard electrical current but could probably be operated by a direct current source. The trimming edges as well as the guide mechanism will be identical in both embodiments.

The push switch will allow an individual to press the switch and a pressure sensitive actuator or solenoid will engage the arms of a horizontal member, which is connected to the other horizontal member and hinged at one end. When the solenoid activates, the trimming edges will close on the fingernail or toenail.

It is an object of this device to make a device that will allow an individual to clip toenails and fingernails safely and easily.

DETAILED DESCRIPTION OF THE EMBODIMENTS

Figure 2:
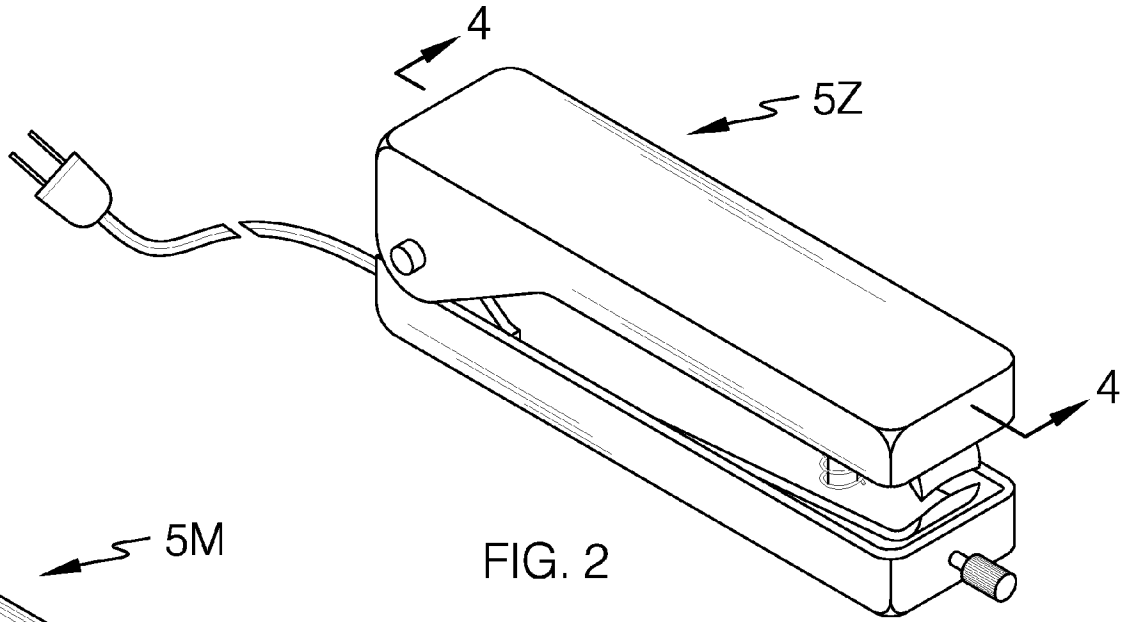
FIG. 2 is an isometric view of the electric version.
Figure 1:
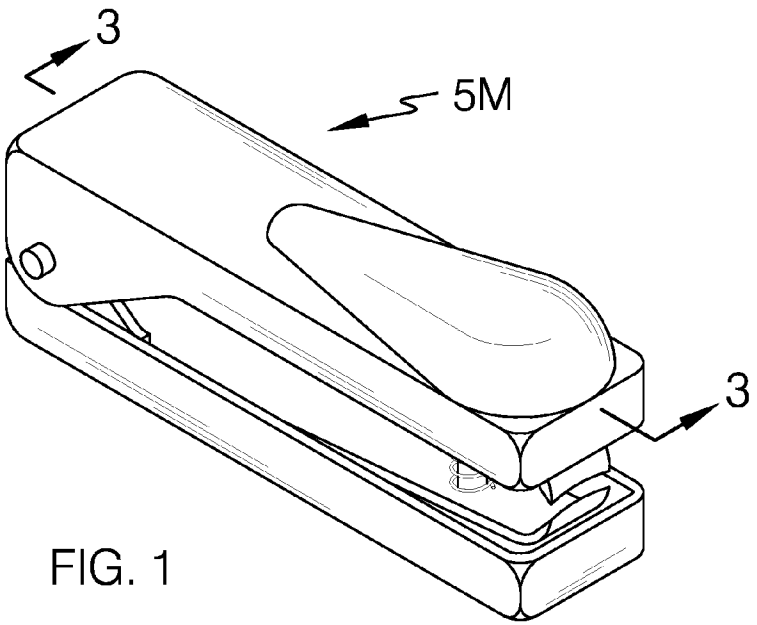
FIG. 1 is an isometric view of the manual version.
Figure 3:
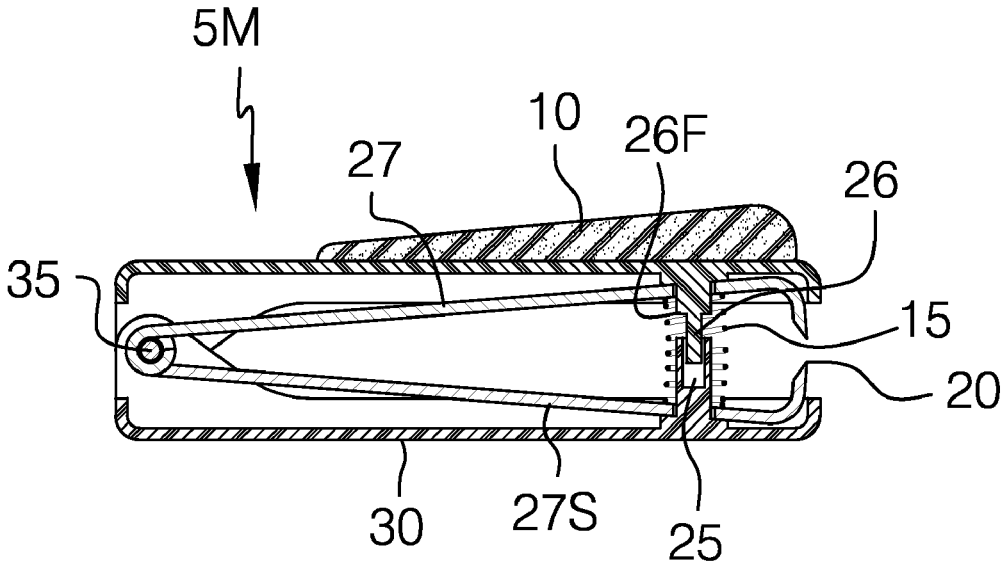
FIG. 3 is a view according to line 3-3 on FIG. 1.
Figure 4:
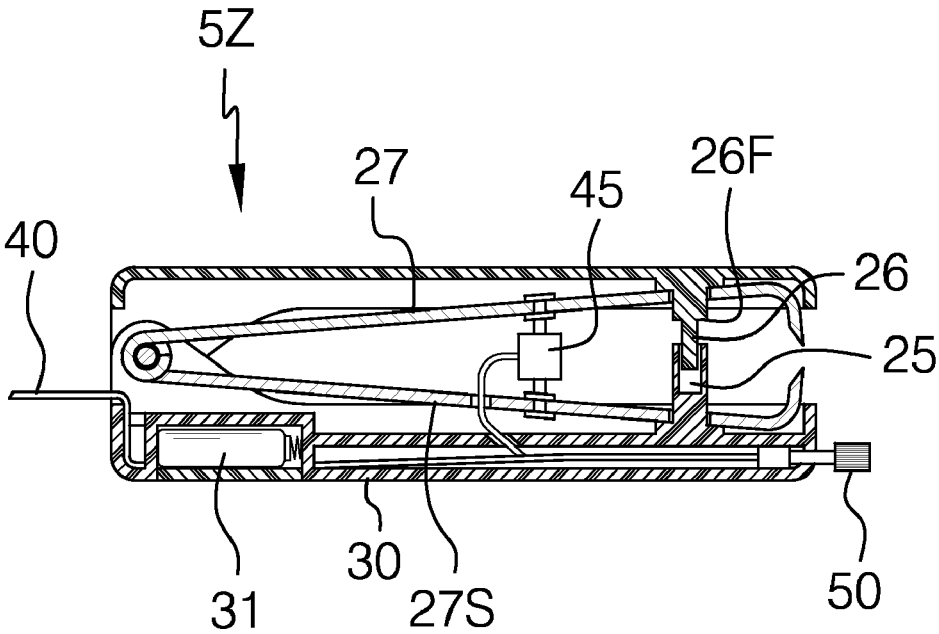
FIG. 4 is a view according to line 4-4 on FIG. 2.

This device is a toenail and fingernail clipper that comes in two basic embodiments: a manual version, 5M, such as depicted in FIGS. 1 and 3 and an electric version, 5Z, such as depicted in FIGS. 2 and 4.

The operation and object of this device is identical. This device will clip toenails and fingernails conveniently and safely. The electric version will be used for individuals who have limited strength in their arms or hands. The manual version will operate like a stapler to remove the unwanted toenail or fingernail.

Regardless of which embodiment is used the device will be comprised of a pair or horizontal members, 27 and 27S, that are contained within a casing 30. Trimming edges 20 will be positioned on the ends of the horizontal members 27, 27S to clip the nail when the device is used. The trimming edges 20 are positioned outside the casing, which permits a person to insert a toenail or fingernail between the trimming edges 20 when the device is operated.

The two horizontal members 27, 27S will be connected together at a pivot point 35, probably secured by a pin located at the junction of the two horizontal members. At the opposite end of the horizontal members will be the trimming edges 20. The trimming edges 20 will be tapered to insure that a nail can be clipped.

One of the horizontal members 27S is stationary and the other horizontal member 27 moves as the device is operated.

First Embodiment-Manual Model

In the manual version, 5M, the components of the device will be housed in a casing 30. On the top surface of the casing a pad 10 for the convenience and comfort of the user will be provided.

In the interior of the casing 30 will be two trimming edges 20, which will be opposed to each other. The trimming edges 20 will be positioned at one end of a pair of horizontal members 27, 27S that are connected at a pivot 35 at one end of the casing 30.

A spring 15 will be positioned between the two horizontal members 27, 27S to allow appropriate tension to ensure that the device remains open and the trimming edges 20 remain separated when not in use. In order that the trimming edges 20 move in a vertical direction to appropriately clip the nail a certain predetermined distance, a guide cavity 25 will be provided.

A protrusion 26 that has a certain configuration will be used. A portion of the protrusion is placed within the cavity 25 and will move a predetermined distance within the cavity 25. The protrusion 26 is designed with a flanged surface 26F so that the movement of the protrusion 26 within the cavity 25 is restricted.

The protrusion 26 within the cavity 25 will also ensure that the trimming edges 20 remain in alignment during normal operation but also prevent the trimming edges 20 from moving beyond a certain point.

Alternative Embodiment-Electric Model

In the alternative embodiment, 5Z, the components will be housed in a casing 30. The trimming edges 20 will be positioned on one end identical to the manual model. Again, the horizontal members would be connected together at the pivot point 35 at the junction of the two horizontal members.

The difference between the manual and electrical models is that the electric embodiment will be powered by standard electrical current. A cord 40 allows the device to be plugged into a wall socket. Alternatively, the device may also be operated by a battery 31.

On the front surface of the device a switch 50 that will activate a pressure sensitive actuator or solenoid 45 is provided. The solenoid 45 is connected to the two horizontal members 27, 27S and when activated will force the horizontal members to move closer together. The solenoid 45 will maintain the position of the trimming edges 20 a certain predetermined distance apart from each other when not in use.

When the switch 50 is depressed, the pressure sensitive actuator or solenoid 45, which is attached to the horizontal members, activates to bring the horizontal members closer together and bring the trimming edges 20 together to clip the nail.

As in the manual model, a guide cavity 25 is provided to ensure that the trimming edges 20 move in an appropriate direction relative to each other to clip the nail. The guide cavity 25 will ensure that the trimming edges 20 move in a vertical direction to appropriately clip the nail a certain predetermined distance.

A protrusion 26 that is tapered with a flanged surface 26F will move within the guide cavity 25 to ensure appropriate alignment as the trimming edges 20 move towards each other to clip the nail but prevent the trimming edges from moving beyond a certain point.

Because the movement of the horizontal members 27 and 27S is controlled by the solenoid 45, no spring is used with this embodiment as the solenoid will keep the trimming edges 20 a certain predetermined distance apart when not in use.

The inventor claims:

1. A nail clipper, which is comprised of:

a. a casing;

wherein the casing houses the components of the nail clipper;

wherein the casing has a predetermined configuration;

b. a pair of horizontal members;

wherein said pair of horizontal members are provided;

a first one of said first horizontal members is stationary;

a second one of said second horizontal members moves when the nail clipper is operated;

said horizontal members are housed within the casing;

wherein the horizontal members each have a first end and a second end;

wherein the first end of the horizontal members are joined;

wherein a trimming edge is positioned at the second end of each of the horizontal members;

c. a pivot point;

wherein the pivot point secures the horizontal members;

said pivot point is housed within the casing;

d. said trimming edges;

wherein said trimming edges are positioned opposed to each other;

said trimming edges are tapered;

said trimming edges are positioned outside the casing;

e. a switch;

wherein said switch activates a solenoid;

f. said solenoid;

wherein said solenoid is connected to a portion of the pair of horizontal members;

g. a guide cavity;

wherein said guide cavity is provided to ensure the appropriate alignment of the trimming edges as they move towards each other to clip a nail;

h. a protrusion;

wherein said protrusion is provided;

said protrusion has a predetermined shape;

said protrusion fits within the guide cavity;

wherein a flanged surface on the protrusion is provided;

said flanged surface restricts the movement of the protrusion;

h. a power source;

wherein said power source is provided.

2. The nail clipper as described in claim 1 wherein the power source is an alternating current source.

3. The nail clipper as described in claim 1 wherein the power source is a direct current source.

* * * * *